US005133680A

United States Patent [19]

Watson et al.

[11] Patent Number: 5,133,680

[45] Date of Patent: Jul. 28, 1992

[54] SLOTLESS FEMALE CONTACT

[75] Inventors: Paul B. Watson; Julius K. Botka, both of Santa Rosa, Calif.

[73] Assignee: Hewlett-Packard Company, Palo Alto, Calif.

[21] Appl. No.: 584,314

[22] Filed: Sep. 18, 1990

[51] Int. Cl.[5] ..... H01R 13/00

[52] U.S. Cl. ..... 439/824

[58] Field of Search ..... 439/181, 186, 187, 819, 439/824, 851, 856, 857, 861, 862

[56] References Cited

U.S. PATENT DOCUMENTS 3,171,183 3/1965 Johnson ..... 439/824

3,474,386 10/1969 Link ..... 439/181

FOREIGN PATENT DOCUMENTS 834754 5/1960 United Kingdom ..... 439/181

*Primary Examiner*—Joseph H. McGlynn

*Attorney, Agent, or Firm*—William C. Milks, III

[57] ABSTRACT

A female contact having a shell that encloses a collet that has an opening in a first end of the collet and that has a second end that is configured so that, when a male pin is inserted through the first end of the collet, it pushes on the second end of the collet either directly or indirectly through some mechanism such as a spring. This female contact has a small diameter that makes it particularly suitable for certain applications and in some embodiments extends outward from the shell to facilitate inserting a male pin into the collet.

13 Claims, 7 Drawing Sheets

SLOTLESS FEMALE CONTACT

BACKGROUND OF THE INVENTION

In the figures, the first digit of a reference numeral will indicate the first figure in which that element is discussed.

This invention relates in general to female electrical contacts and relates more particularly to slotless female contacts that are suitable for use in the inner conductor of a connector that, at microwave frequencies, does not introduce variable performance that can limit resolution of an instrument utilizing such a connector.

In FIG. 1 is illustrated connection between a pair of prior art connectors 10 and 10', each having a female contact at the end of its inner conductor. Connector 10 comprises an outer conductor 11, an inner conductor 12 and a slotted collet 13 that is partially contained within a cavity 14 in the inner conductor. Slots 15 in collet 13 enable it to make contact with inner conductor 12 at a point 16 substantially at the front face of inner conductor 12 and to enable it to be pressed into cavity 14 in response to pressure from a collet 13' in second connector 10' to which first connector 10 is connected. Analogous elements of connector 10' are indicated by corresponding primed reference numerals.

Unfortunately, mated front faces 17 and 17' of the collets may not be coplanar with the mated ends 19 and 19' of the outer conductors 11 and 11'. If collet 13 is stiffer than collet 13', then, as illustrated in this figure, collet 13 will extend farther outward from cavity 14 than does collet 13' from cavity 14'. Thus, near the end of each of these connectors, the impedance experienced by a microwave signal will depend on the interaction between the two inner conductors. If connector 10 were instead connected to a different connector, then collet 13 would wind up protruding more or less than it does when connected to connector 10' and thereby exhibit a different impedance for that connection.

Microwave signals have a small enough wavelength that the spatial variation in the diameter of the inner conductor between planes 19 and 110 will produce a spatially varying impedance in that region. A reference termination can be coupled to connector 10 to enable an instrument to be calibrated to compensate for this spatial variation between planes 19 and 110. However, this calibration will be meaningful only if this spatial variation is unchanged when the reference termination is replaced by another connector used during actual measurements. Because the connector of FIG. 1 exhibits an impedance that is dependent on what it is coupled to, such calibration cannot completely compensate for the spatial variation of the inner conductor. Existing measuring instruments are sufficiently sensitive that such variable impedance can limit the sensitivity of the measuring device.

In FIG. 2 is shown a female connector 20 that is suitable for use at microwave frequencies (See U.S. Pat. No. 4,797,126 entitled "Adjustable Length Slotless Female Contact For Connectors" issued to Julius Botka on Jan. 10, 1989). In this connector, a collet 23 is designed such that this collet repeatedly makes contact with a wall 211 of inner conductor 22 at a point 26 that is substantially independent of the parameters of a male pin that is inserted through an end 27 of this connector. This female connector therefore has very favorable operating characteristics, but it does have several drawbacks. The inner conductor contains a collet design that is substantially larger in diameter than the range of male pin diameters that it can accommodate. Therefore, it is not suitable to applications where the ratio of the diameter of the female contact to the diameter of the male contact must be low.

Also, there are some situations in calibration where a coaxial airline is used in which no dielectric support is included to hold the inner conductor concentric with the outer conductor. For such reference terminations, the inner conductor lies on the bottom of the inner wall of the outer conductor. It is difficult to properly connect both ends of the airline. When one end of the airline is connected to another device, that end is supported by the other device, but the other end continues to droop onto the inner surface of the airline's outer conductor. In coupling a second device to the unsupported end of the airline, as the airline and this second device are brought into close proximity for coupling, it is difficult to peer inside of the airline to properly guide mating of the center conductors. This makes it difficult to accomplish such additional coupling without damaging the center conductor of the airline. A design would therefore be useful that overcomes this difficulty.

SUMMARY OF THE INVENTION

In accordance with the illustrated preferred embodiments, a female contact is presented that provides an extremely repeatable spatial variation of impedance both for that contact and for a male contact to which it is connected. This female contact includes a cylindrical outer shell having an opening at a first end through which a male pin is to be inserted. This cylindrical shell encloses a cavity within which is retained a cylindrical slotted collet that is open at one end to enable the male pin to be inserted therein. The other (second) end of the collet is configured such that the inserted male pin pushes against this end of the collet either directly or indirectly through some mechanism such as a spring. This contrasts with most other devices, such as that illustrated in FIG. 3, in which a male pin 31 includes a shoulder 32 that is used to apply pressure to the collet 33 at the open end 34 of the collet. The new design presented herein has an advantage of providing a more stable manner of applying force to the collet.

In this new design, near the open end of the collet, the outer wall flares outward at an angle such that it produces a wiping contact with the sloping wall of the open end of the cylindrical shell, thereby producing good electrical contact with that end of the shell. The second end of the collet has a resilient member, such as a spring, so that this female contact can accommodate a range of diameters of male contact pin. The stiffness of this resilient member is selected to be large enough that the tines of the collet close down on the male pin before the pin has been fully inserted into the collet, thereby producing a wiping contact between the male pin and the collet. This produces a good electrical contact at substantially the open end of the collet. Also, to accommodate a wider range of male pin lengths, the wall of the collet between the first and second ends of the collet can be slotted to provide an axially flexible element.

In one class of embodiments, the second end of the collet is connected to a spring that extends the collet outward from the open end of the enclosing cylindrical shell. Such extension of the collet makes it easier to insert the male pin into the collet, especially when this female connector is utilized with an airline in which there is no dielectric support centering the inner conductor.

DESCRIPTION OF THE INVENTION

Figure 1:
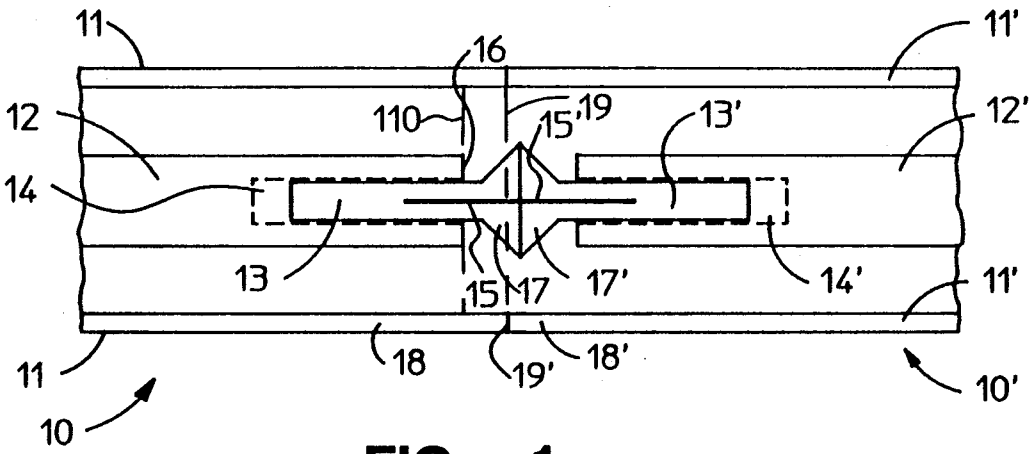
FIG 1 (PRIOR ART)
FIG. 1 illustrates a problem in calibrating one type of prior art female contact.
Figure 3:
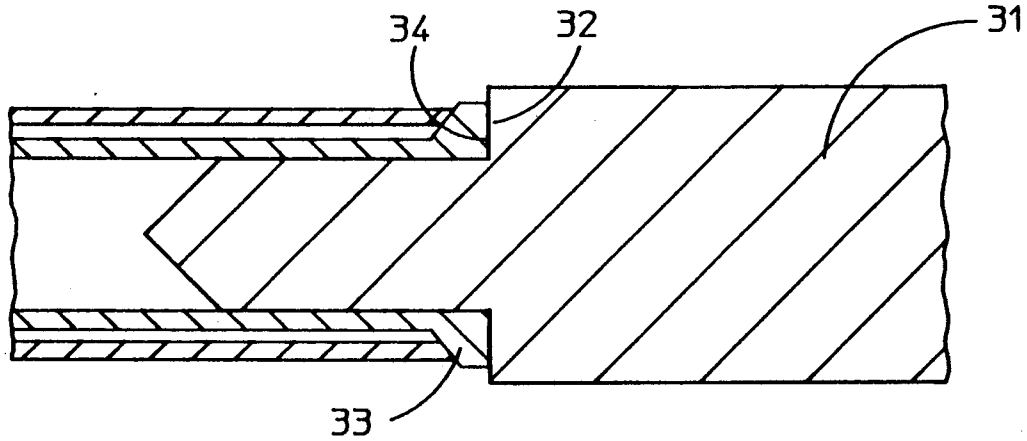
FIG 3 (PRIOR ART)
FIG. 3 illustrates the use of a shoulder on some prior art male pins to press a collet in a mated female connector firmly against an end of a cylindrical shell enclosing the collet.
Figure 2:
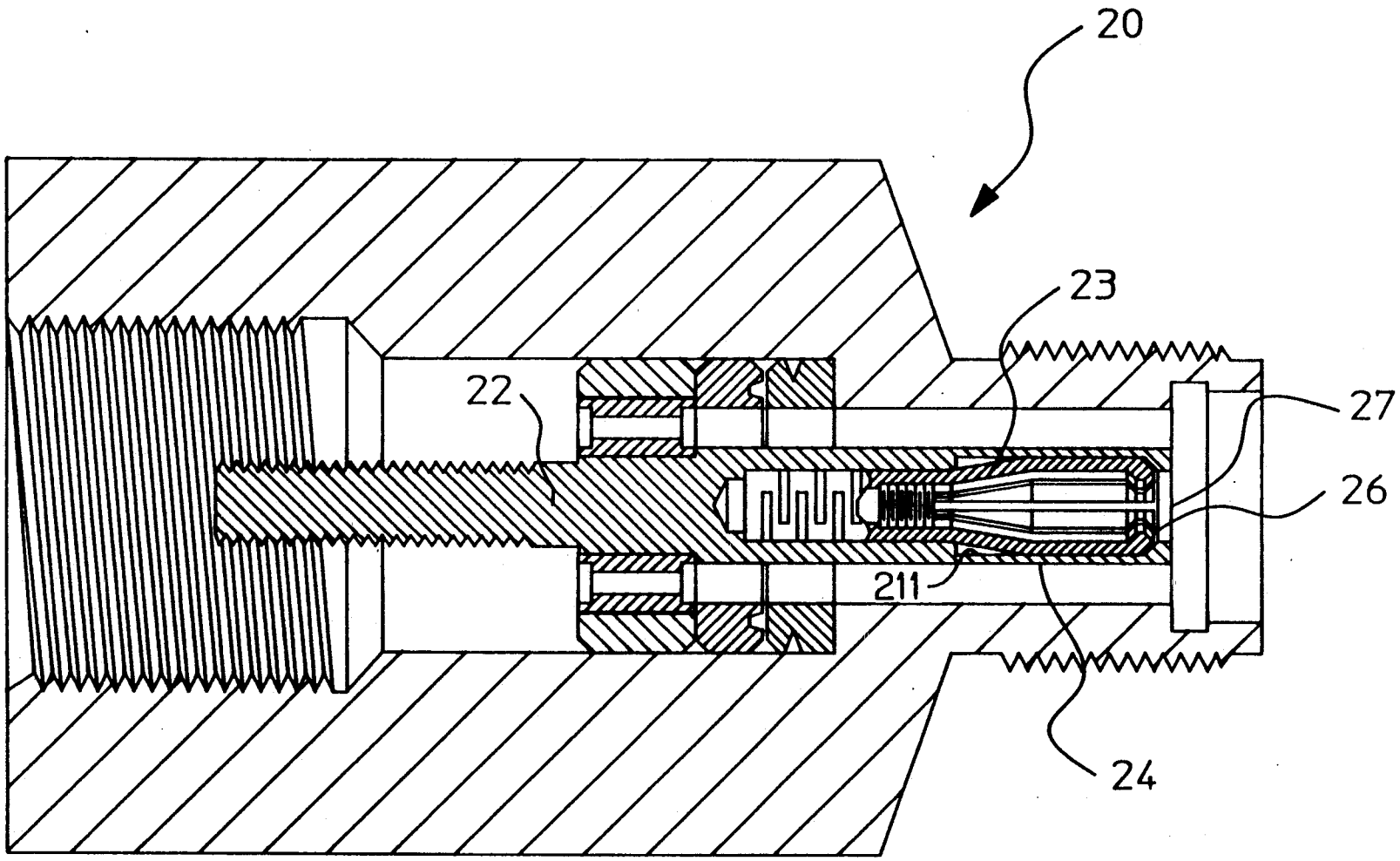
FIG 2 (PRIOR ART)
FIG. 2 shows a prior art female contact that provides good performance, but is not suitable for use in applications requiring a female contact with a diameter only slightly larger than the diameter of the male pin to be mated with it.
Figure 4A:
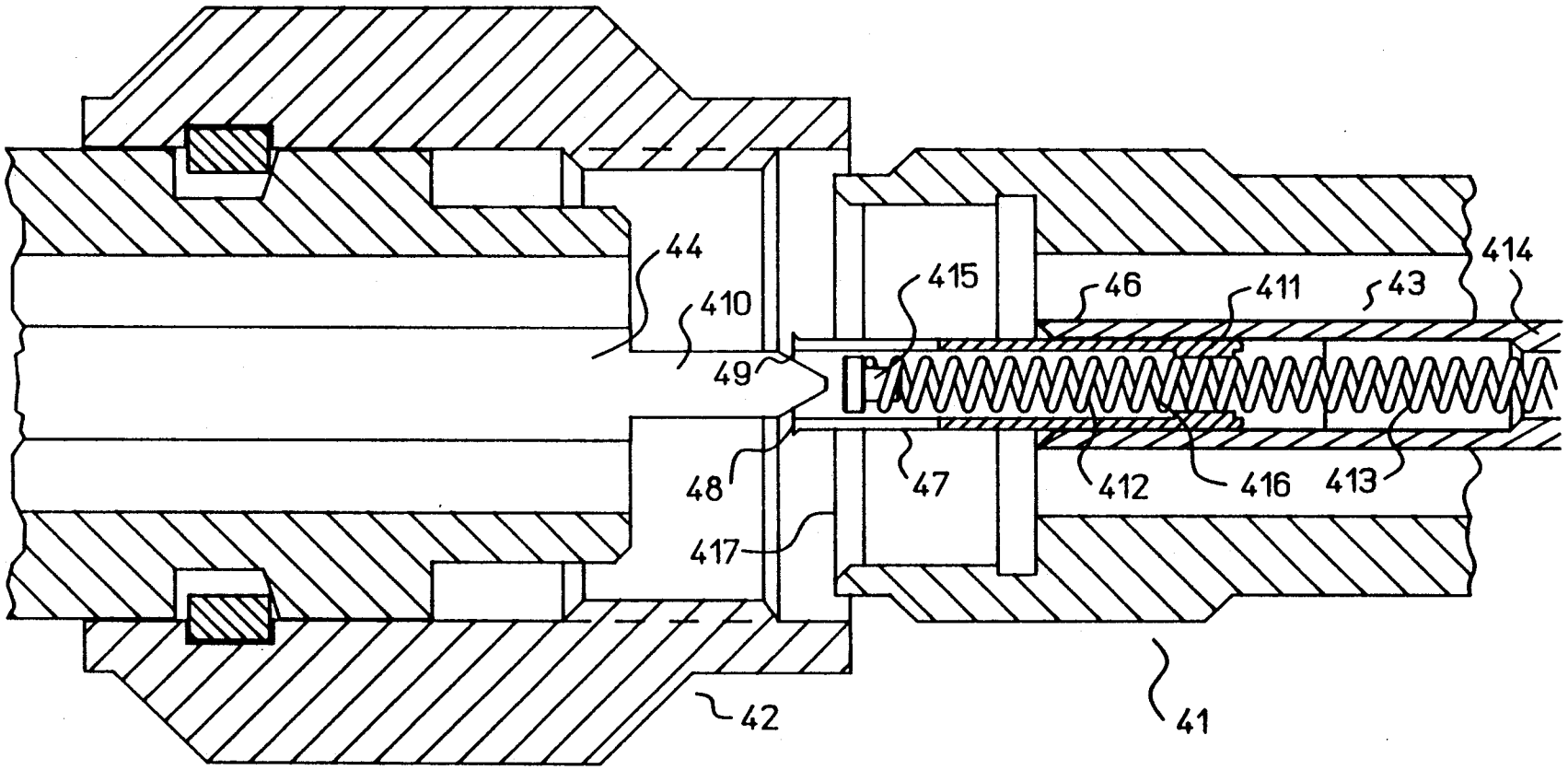
FIG. 4A shows a preferred embodiment of the female contact at a point at which a male pin is just being inserted into the female contact.

In FIG. 4A is illustrated a female connector 41 being coupled to a male connector 42. The inner conductors of connectors 41 and 42 are terminated by a female contact 43 and male contact 44, respectively. Female contact 43 includes a cylindrical shell 46 within which slides a slotted collet 47 having a first end 48 containing an opening 49 through which a pin 410 of male connector 42 is being inserted. The other (second) end 411 of collet 47 contains a compressible element, such as spring 412, against which pin 410 presses. This spring transmits this pressure to the second end of the collet. Pressing against end 411 has the advantage of being a more stable manner of transmitting force to the collet than results from pressing on end 48, as is common in the prior art. In the prior art, the male pin generally contains a shoulder that presses against the open end of the collet to press the collet against its enclosing shell and produce good electrical contact between the male and female connectors, as shown in FIG. 3.

As can be seen from FIG. 4A, the male pin typically does not extend past the end of the male connector. This can make it difficult to ensure that the male pin is inserted into the female contact of the female connector. This is especially true in the case of an airline connector of the type in which there is no dielectric support centering the inner conductor within the outer conductor of the male connector. Therefore, this embodiment also contains a mechanism for projecting collet 47 out of opening 417 when female connector 41 is not coupled to another connector. This enables a user to guide this projected collet onto the pin of the male connector.

In this embodiment, a spring 413 connects second end 411 of the collet to a rear end 414 of shell 46. The length of spring 413 is selected to extend collet 47 out of opening 417 when female connector 41 is not mated to a male connector. As shown in this figure, springs 412 and 413 can actually be a single spring that is threaded into end 411 of collet 47 and into end 414 of shell 46. A fitting 415 is attached to one end of spring 412 to provide a flat surface against which pin 410 can press.

Figure 4B:
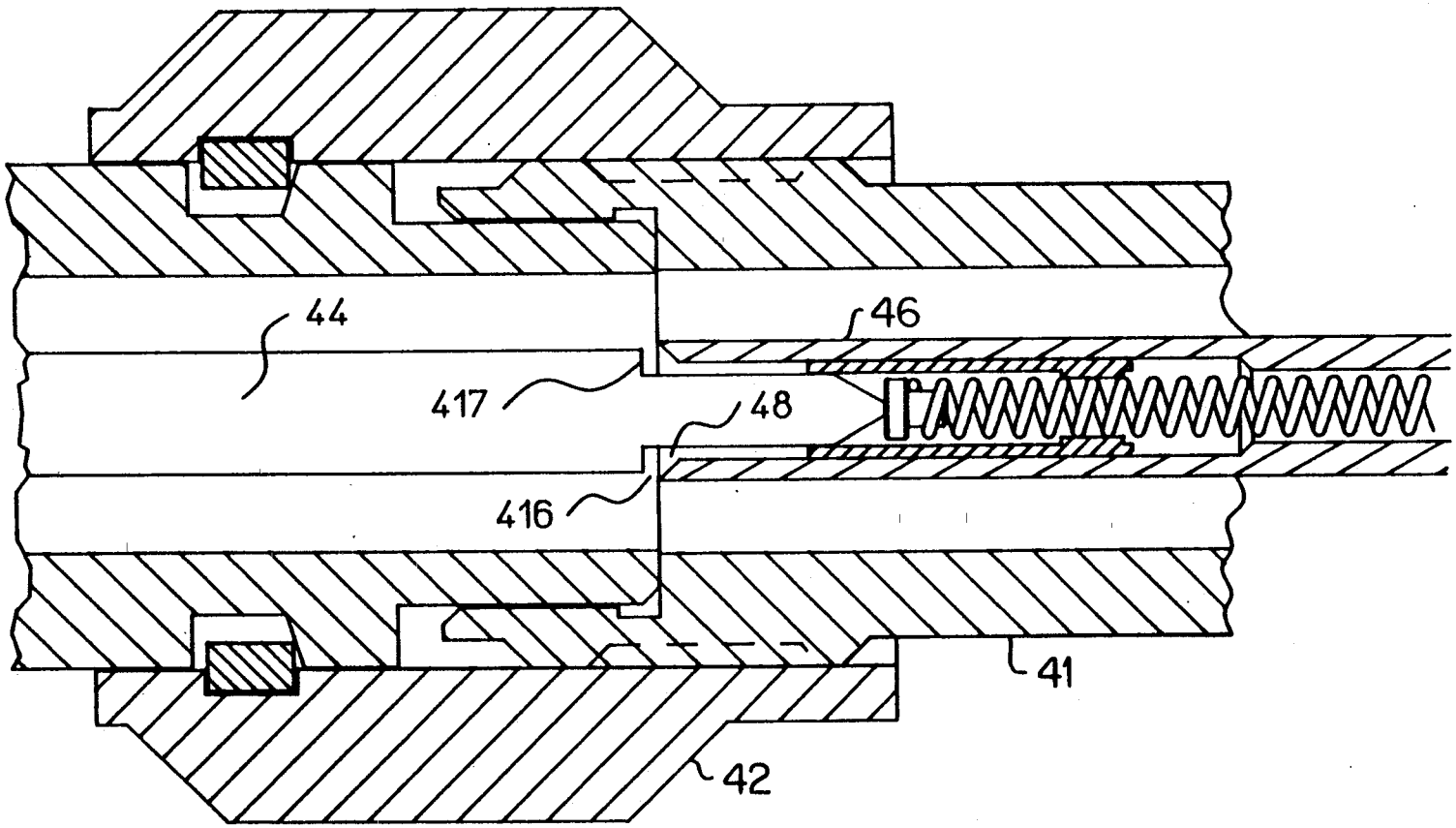
FIG. 4B shows the female contact after the male pin has been fully inserted.
Figure 5:
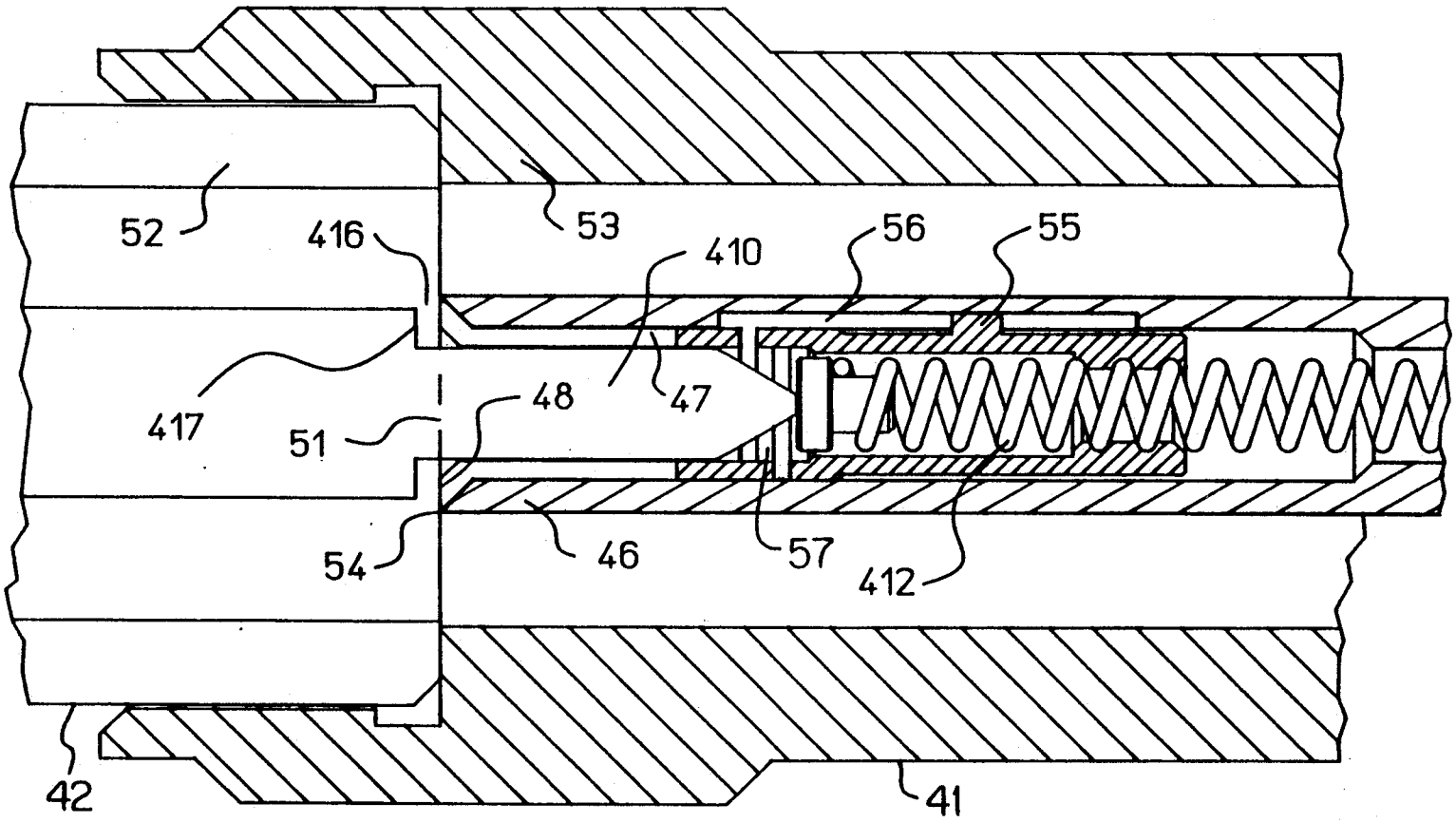
FIG. 5 is an expanded view of the collet and enclosing cylindrical shell to illustrate how wiping contacts are produced by this female contact.

In FIG. 4B, connectors 41 and 42 are shown fully mated. It should be noted that there is a gap 416 between collet end 48 and a shoulder 417 of pin 44. This gap is shown in greater detail in FIGS. 5 and 6 and makes clear that shoulder 417 does not press against end 48 of collet 47. Indeed, as illustrated in FIG. 5, to ensure that shoulder 417 does not press against collet 47, this shoulder 417 is purposely set back from plane 51 which is tangent to the ends of the outer conductors 52 and 53 of connectors 41 and 42, respectively. Preferably, collet 47 also includes a projection 55 which extends into a slot 56 in shell 46 to retain the collet within shell 46 while allowing the collet to slide longitudinally within cylindrical shell 46. Also, to accommodate a wider range of lengths of male pin 410, a portion 57 of collet 47 between first end 48 and second end 411 can be slotted to provide an axially flexible element.

Figure 6:
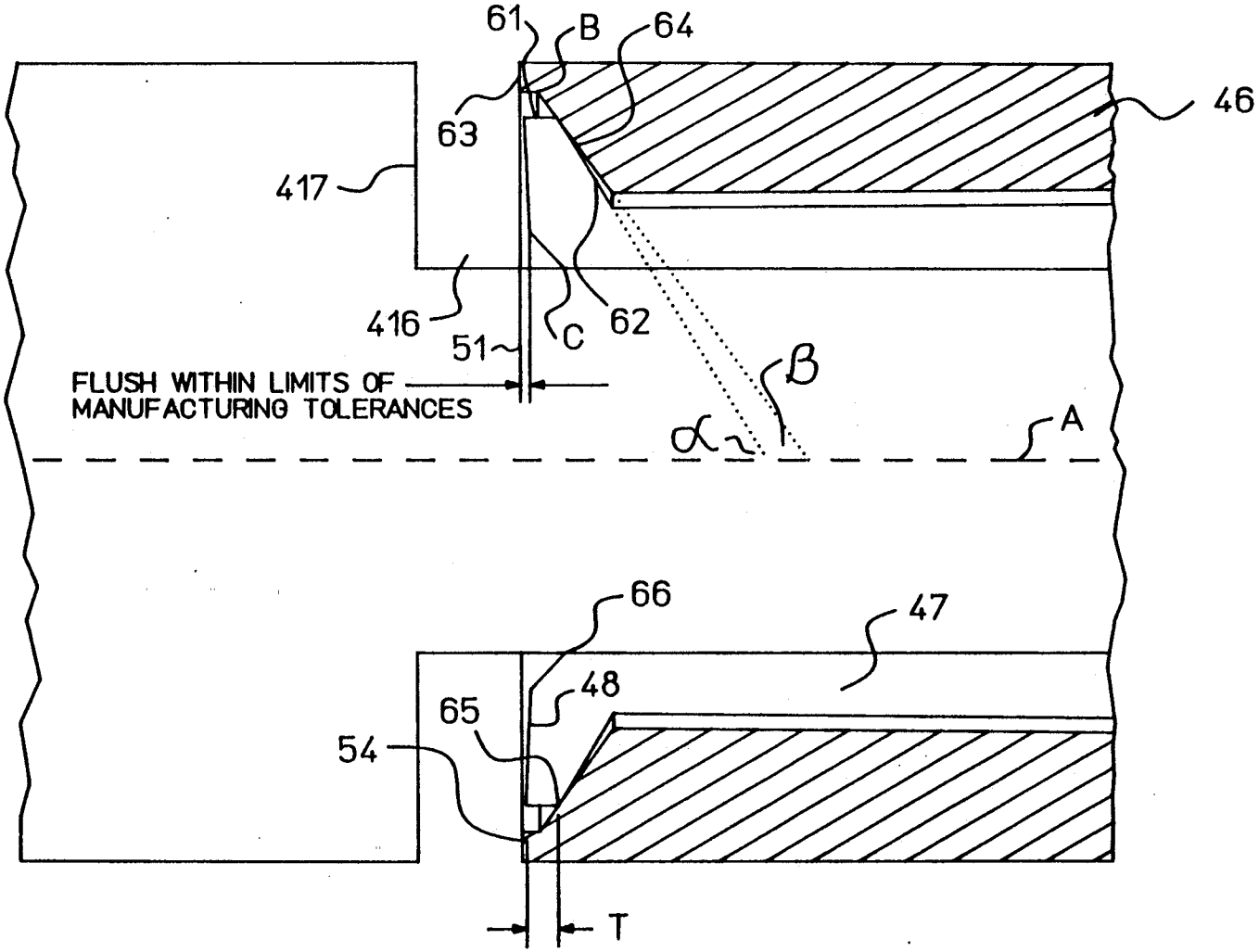
FIG. 6 shows in greater detail the construction of the open end of the collet.

As is illustrated in FIG. 6, collet 47 is designed so that its end 48 is substantially coplanar with plane 51 and with end 54 of shell 46. Deviation from coplanarity between plane 51 and end 48 is due only to the limits of manufacturing tolerances. Such substantial coplanarity is important in avoiding a phase delay in part of the current being supported on the inner conductor. Such phase delay would manifest itself as an unwanted inductance at the connection.

If this contact is utilized on a test port of a network analyzer, then the phase delay introduced by the noncoplanarity of collet end 48 and plane 51 could be calibrated out of a measurement. However, to produce such a calibration, a reference connector is required for which such unknown phase delay is not present. Such a reference connector should exhibit a perfect 50 ohm impedance clear up to plane 51 so that the calibration can be made for a perfect 50 ohm standard impedance. Therefore, substantial elimination of the phase delay makes this connector suitable for use in a calibration measurement.

At end 48 of collet 47, the collet flares outward in a flare 61 having an inner surface 62 forming an angle $\alpha$ with a common axis A of the collet and shell. End 63 of shell 46 has an inclined surface 64 that forms an angle $\beta$ with axis A. Angle $\alpha$ is selected to be greater than angle $\beta$ so that shell 46 and collet 47 make contact at a point 65 that is very close to plane 51. The closeness is determined by the thickness T of flare 61 at the point of contact. This thickness is in turn determined by the minimal thickness allowable which retains adequate strength to prevent bending flare 61 during use. In a 3.5 mm inner diameter version of this connector, T, $\alpha$ and $\beta$ are on the order of 0.001", 61° and 55°, respectively. Angle $\beta$ is selected to be on the order of 55° so that wiping contacts are formed at contact points B and C.

Collet 47 is divided by a plurality of axial slots into an equal number of tines. As male and female connectors 41 and 42 are being connected, the pressure of pin 410 on spring 412 presses flare 61 against sloping wall 64 hard enough that flare 61 of the tines of slotted collet 47 are slid inward along sloping surface 64, thereby making a wiping contact 65 between flare 61 and sloping surface 64. The stiffness of spring 412 is large enough (on the order of 16 pounds per inch) that the tines make contact between pin 410 before pin 410 is fully inserted into collet 47. As a result of this, a wiping contact 66 is made between these tines and pin 410. These two wiping contacts ensure that good electrical contact is formed between male contact 44 and female contact 43.

Figure 7:
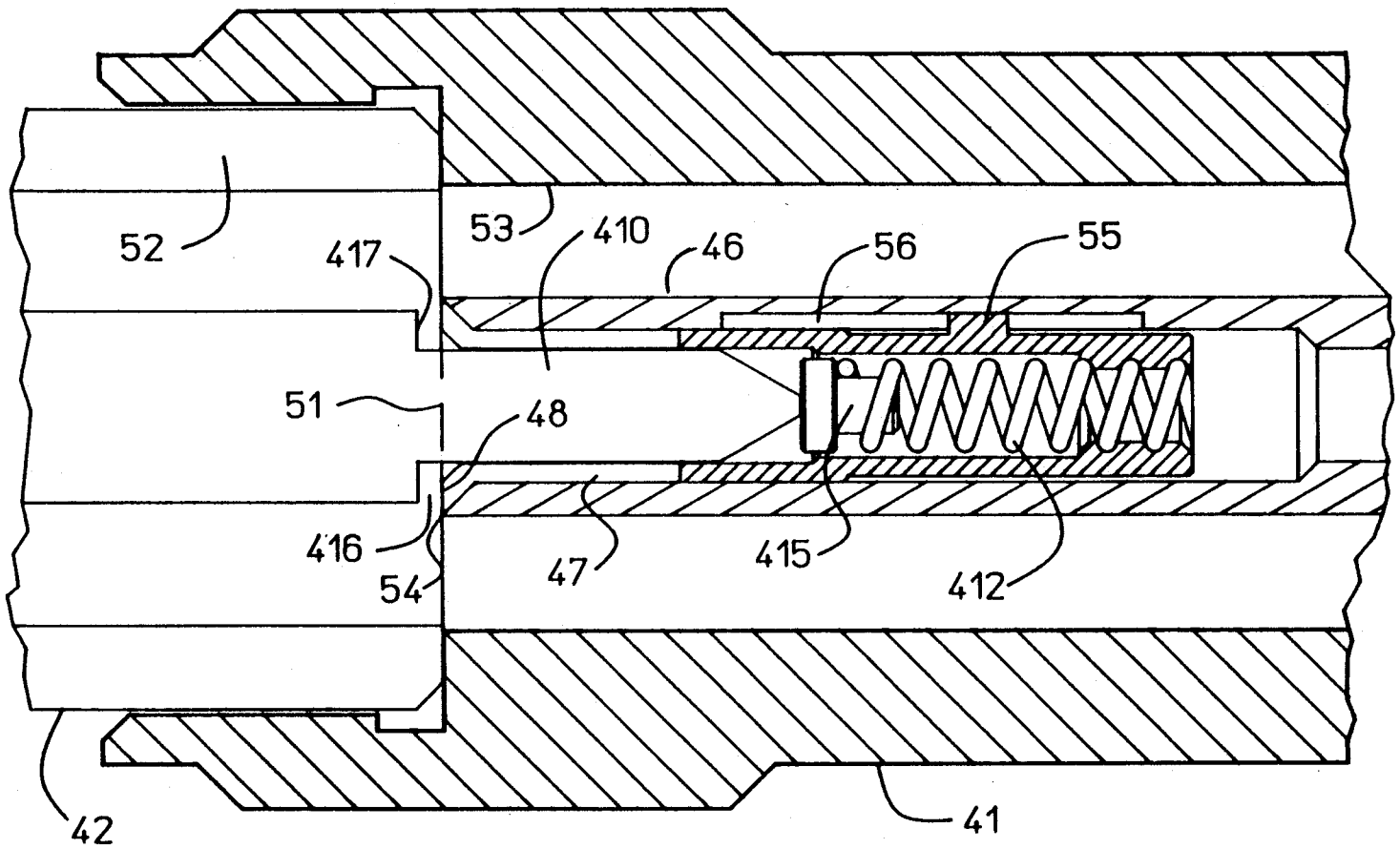
FIG. 7 shows an alternate embodiment in which the collet is not forced outward to simplify guiding the male pin into the collet of the female contact.

In FIG. 7 is presented an alternate embodiment in which spring 413 has been eliminated. This is therefore a simpler design, but should not be used in an airline type embodiment in which there is not a dielectric spacer centering the inner conductor within the outer conductor of the connector.

We claim:

1. A female contact comprising:

an electrically conductive shell having an opening in a first end, the first end of said shell lying in a plane;

a collet inserted through said opening in the first end of said shell;

said collet having a first end that includes an opening through which a male pin is to be inserted;

said collet also having a second end with means connected to the second end that is configured such that the inserted male pin engages the means, whereby, when this female contact is mated to a male contact, the collet is pressed into said shell by force transmitted by said means and applied to the second end of said collet;

a portion of said collet at the first end of the collet being configured such that when the female contact is mated with the male contact having the male pin, the portion of the collet makes electrical contact with the shell substantially in the plane.

2. A female contact as in claim 1 wherein said second end of the collet includes an elastic member, in contact with the second end, against which said male pin presses when said male and female contacts are mated, thereby pressing against said second end via said elastic member.

3. A female contact as in claim 1 wherein said collet further comprises a projection which extends into a slot in said shell to retain the collet within the shell while allowing the collet to slide longitudinally within the shell.

4. A female contact as in claim 1 further comprising means for extending said collet outward through said opening in the shell when the female contact is not in contact with a male contact and for allowing the collet to be pressed into said shell when the female contact is mated with a male contact.

5. A female contact as in claim 4 wherein said means for extending comprises an elastic member connected between the second end of the collet and a second end of the shell.

6. A female contact as in claim 1 wherein, at the first end of the collet, the portion of the collet flares outward such that when the female contact is mated with the male contact, this flaring portion of the collet makes electrical contact with the shell substantially in the plane.

7. A female contact as in claim 6 wherein the first end of the shell includes a sloping wall and wherein said electrical contact between the collet and the shell occurs on this sloping wall of the shell.

8. A female contact as in claim 7 wherein said shell and collet are coaxial with a common axis A, wherein said flaring portion of the collet has an inner surface that forms an angle $\alpha$ with axis A, wherein the sloping wall at the first end of the shell forms an angle $\beta$ with axis A and wherein angle $\alpha$ is greater than angle $\beta$ so that the point of contact between the flaring portion of the collet and the shell is substantially in the plane.

9. A female contact as in claim 8 wherein, as the female contact is mated with a male contact, the collet forms a wiping electrical contact with the shell.

10. A female contact as in claim 8 wherein, when the female contact is mated with a male contact, the first end of the shell is substantially coplanar with the first end of the collet.

11. A female contact as in claim 8 that is mated to a male contact having a male pin having a sufficient diameter and length that, as the male pin is being inserted into the open end of the collet, the collet presses inward against the male pin forming a wiping contact.

12. A female contact as in claim 1 wherein a portion of the collet between its first and second ends is slotted to provide an axially flexible element for accommodating a range of lengths of male pins.

13. A female contact as in claim 12 wherein said collet further comprises a projection which extends into a slot in said shell to retain the collet within the shell while allowing the collet to slide longitudinally within the shell.

* * * * *